US009312664B2

(12) United States Patent
Yoshida et al.

(10) Patent No.: US 9,312,664 B2
(45) Date of Patent: Apr. 12, 2016

(54) SPARK PLUG

(71) Applicant: NGK SPARK PLUG CO., LTD., Nagoya-shi, Aichi (JP)

(72) Inventors: Haruki Yoshida, Tajimi (JP); Takamitsu Mizuno, Hashima (JP); Satoshi Yano, Konan (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/419,590

(22) PCT Filed: Mar. 20, 2013

(86) PCT No.: PCT/JP2013/001886

§ 371 (c)(1),
(2) Date: Feb. 4, 2015

(87) PCT Pub. No.: WO2014/024345

PCT Pub. Date: Feb. 13, 2014

(65) Prior Publication Data

US 2015/0214697 A1 Jul. 30, 2015

(30) Foreign Application Priority Data

Aug. 9, 2012 (JP) ..... 2012-176824

(51) Int. Cl.
*H01T 13/20* (2006.01)
*H01T 13/40* (2006.01)
*H01T 13/41* (2006.01)

(52) U.S. Cl.
CPC ..... *H01T 13/20* (2013.01); *H01T 13/40* (2013.01); *H01T 13/41* (2013.01)

(58) Field of Classification Search
CPC ..... H01T 13/41; H01T 13/20; H01T 13/40
USPC ..... 313/141, 136
See application file for complete search history.

(56) References Cited

U.S. PATENT DOCUMENTS

2012/0126683 A1* 5/2012 Yoshida ..... H01T 13/41 313/141

FOREIGN PATENT DOCUMENTS

| | | | |
|---|---|---|---|
| JP | S61-284903 A | 12/1986 | ..... H01B 1/18 |
| JP | H09-306636 A | 11/1997 | ..... H01T 13/20 |
| JP | 2006-066086 A | 3/2006 | ..... H01T 13/20 |

OTHER PUBLICATIONS

International Search Report from corresponding International Patent Application No. PCT/JP2013/001886, dated May 7, 2013 (English-language translation provided).

*Primary Examiner* — Vip Patel
(74) *Attorney, Agent, or Firm* — Kusner & Jaffe

(57) ABSTRACT

A spark plug having a resistor containing $SiO_2$ and $B_2O_3$. The glass is a phase-separated glass having aggregate phase and an intervening phase. In a cross section of the resistor, when a plurality of imaginary lines perpendicular to an axial line CL1 are drawn at intervals of 0.1 mm in the direction of the axial line CL1, the number of aggregate phase located on each of the imaginary lines is determined, and the average number of aggregate phase per imaginary line is determined for each of a plurality of line groups each comprised of five consecutive imaginary lines, there are three or more consecutive line groups which satisfy the condition that the average number of aggregate phase per imaginary line is larger, by 5 or more, than the minimum average number of aggregate phase per imaginary line among the plurality of line groups.

6 Claims, 6 Drawing Sheets

SPARK PLUG

RELATED APPLICATIONS

This application is a National Stage of International Application No. PCT/JP2013/001886 filed Mar. 20, 2013, which claims the benefit of Japanese Patent Application No. 2012-176824, filed Aug. 9, 2012.

FIELD OF THE INVENTION

The present invention relates to a spark plug used for, for example, an internal combustion engine.

BACKGROUND OF THE INVENTION

A spark plug is attached to a combustion apparatus (e.g., an internal combustion engine), and is employed for ignition of an air-fuel mixture or the like. In general, the spark plug includes an insulator having an axial hole; a center electrode inserted into a forward end portion of the axial hole; a terminal electrode inserted into a rear end portion of the axial hole; and a metallic shell provided around the insulator. A resistor may be provided within the axial hole and between the center electrode and the terminal electrode for reducing radio noise generated in association with operation of the combustion apparatus (see, for example, Japanese Patent Application Laid-Open (kokai) No. 2006-66086).

Generally, the resistor is formed by charging, into the axial hole, a resistor composition containing, for example, glass powder (containing silicon dioxide ($SiO_2$) and boron oxide ($B_2O_3$)), an electrically conductive material (e.g., carbon black), and ceramic particles, and by heating and compressing the resistor composition through hot-pressing of the terminal electrode toward the center electrode. The thus-formed resistor is in a phase-separated state such that an intervening phase containing a relatively large amount of $B_2O_3$ is present around aggregate phase containing a relatively large amount of $SiO_2$. The aggregate phase is composed of glass grains from which a $B_2O_3$-rich glass component has been melted, and the intervening phase is generally composed of a molten $B_2O_3$-rich glass component. The intervening phase contains the electrically conductive material and ceramic grains. Thus, the center electrode is electrically connected to the terminal electrode via electrically conductive paths included in the intervening phase, the paths being formed of the electrically conductive material.

From the viewpoint of improving the effect of preventing radio noise (hereinafter may be referred to as "radio-noise-preventing effect"), desirably, the distance between the center electrode and the terminal electrode in the direction of the axial line is increased; i.e., the length of the resistor is increased. However, when a resistor composition containing the aforementioned glass powder having a relatively large mean particle size is employed, and the distance between the center electrode and the terminal electrode is made relatively large, difficulty is encountered in sufficiently increasing the density of the resistor, for the following reasons.

Specifically, since the glass powder having a large mean particle size is less likely to be melted during heating (i.e., a small amount of $B_2O_3$-rich glass component is melted from glass particles), gaps between aggregate phase are insufficiently filled with an intervening phase, and voids (pores) are generated between the aggregate phase. Thus, pressure is likely to be lost during compression. When the distance between the center electrode and the terminal electrode is relatively small, pressure loss is not increased greatly, and thus sufficiently large pressure can be applied to a forward end portion (a portion away from the terminal electrode) of the resistor composition. Therefore, voids (pores) between the aggregate phase can be eliminated through compression in the entire resistor. Consequently, gaps between the aggregate phase are filled with the intervening phase, and the density of the resistor can be sufficiently increased.

Meanwhile, when the distance between the center electrode and the terminal electrode is relatively large, pressure loss during compression is increased, and pressure applied to a forward end portion of the resistor composition is reduced. Therefore, voids generated between the aggregate phase remain in a forward end portion of the resistor; i.e., the density of the resistor is lowered. In this case, the lower the density of the resistor, the smaller the number of electrically conductive paths in the resistor. Thus, the resistance of the resistor having a low density may be drastically increased through partial oxidation of the electrically conductive paths during use of the spark plug, resulting in deterioration of load life performance.

When glass powder having a small mean particle size (e.g., about 100 μm) and being likely to be melted is employed for increasing the density of the resistor, a larger amount of a $B_2O_3$-rich glass component may be melted from glass particles, and gaps between the aggregate phase may be more reliably filled with the intervening phase. However, in such a case, an amount of the $B_2O_3$-rich glass component, which has a relatively low viscosity, is increased in the glass material melted through heating, and the viscosity of the molten glass material is lowered (i.e., the viscosity becomes nearly equal to that of water). Therefore, when pressure is applied to the resistor composition, a larger amount of the glass material is likely to enter a gap between the outer wall of the terminal electrode and the inner wall of the axial hole, and the aforementioned voids (pores) may be insufficiently eliminated through compression. Consequently, the density of the resistor may be lowered, resulting in unsatisfactory load life performance.

Meanwhile, when the resistor composition is prepared by uniformly mixing glass powder having a relatively large mean particle size with glass powder having a relatively small mean particle size, a reduction in viscosity of the molten glass material during heating may be prevented while gaps between the aggregate phase are filled with the intervening phase. However, in such a case, there occurs a phenomenon that glass particles having a relatively small mean particle size are aggregated together. Therefore, although gaps between the aggregate phase are filled with the intervening phase in a portion of the resistor, voids are generated between the aggregate phase in the remaining portion of the resistor, as in the case of employment of only glass powder having a relatively large mean particle size. Consequently, the density of the resistor may fail to be increased, resulting in unsatisfactory load life performance.

In view of the foregoing, an advantage of the present invention is an increase in the density of a resistor that provides excellent load life performance in a spark plug in which the distance between the forward end of a terminal electrode and the rear end of a center electrode is relatively large.

SUMMARY OF THE INVENTION

Configurations suitable for achieving the aforementioned advantage will next be described in itemized form. If needed, actions and effects peculiar to the configurations will be described additionally.

Configuration 1

In accordance with a first aspect of the present invention, there is provided a spark plug comprising:

an insulator having an axial hole extending therethrough in a direction of an axial line;

a center electrode inserted into a forward end portion of the axial hole;

a terminal electrode inserted into a rear end portion of the axial hole; and a resistor which is provided within the axial hole between the center electrode and the terminal electrode, and which contains an electrically conductive material, and a glass containing silicon dioxide ($SiO_2$) and boron oxide ($B_2O_3$), wherein the distance between the forward end of the terminal electrode and the rear end of the center electrode in the direction of the axial line is 15 mm or more;

the glass is a phase-separated glass having aggregate phase containing $SiO_2$, and an intervening phase provided between the aggregate phase;

the aggregate phase has an $SiO_2$ content higher than that of the intervening phase;

the intervening phase has a $B_2O_3$ content higher than that of the aggregate phase; and in a cross section of the resistor, the cross section including the axial line, and having a portion whose center corresponds to the axial line and which has a width of 1.3 mm in a direction perpendicular to the axial line, when a plurality of imaginary lines perpendicular to the axial line are drawn at intervals of 0.1 mm in the direction of the axial line, the number of aggregate phase located on each of the imaginary lines is determined, and the average number of aggregate phase per imaginary line is determined for each of a plurality of line groups each consisting of five consecutive imaginary lines, there are three or more consecutive line groups which satisfy the condition that the average number of aggregate phase per imaginary line is larger, by 5 or more, than the minimum average number of aggregate phase per imaginary line among the plurality of line groups.

Configuration 2

In accordance with a second aspect of the present invention, there is provided a spark plug as described in the aforementioned configuration 1, wherein the length of the resistor in the direction of the axial line is 50% or more of the distance between the forward end of the terminal electrode and the rear end of the center electrode in the direction of the axial line.

Configuration 3

In accordance with a third aspect of the present invention, there is provided a spark plug as described in the aforementioned configuration 1 or 2, wherein in a cross section perpendicular to the axial line, the axial hole has an inner diameter of 3.5 mm or less at the forward end of a region thereof in which only the resistor is present.

Configuration 4

In accordance with a fourth aspect of the present invention, there is provided a spark plug as described in any of the aforementioned configurations 1 to 3, wherein in a cross section perpendicular to the axial line, the axial hole has an inner diameter of 2.9 mm or less at the forward end of a region thereof in which only the resistor is present.

Configuration 5

In accordance with a fifth aspect of the present invention, there is provided a spark plug as described in any of the aforementioned configurations 1 to 4, wherein the distance between the forward end of the terminal electrode and the rear end of the center electrode in the direction of the axial line is 17 mm or more.

Configuration 6

In accordance with a sixth aspect of the present invention, there is provided a spark plug as described in any of the aforementioned configurations 1 to 5, wherein there are two or more portions each including three or more consecutive line groups which satisfy the condition that the average number of aggregate phase per imaginary line is larger, by 5 or more, than the minimum average number of aggregate phase per imaginary line, and the two or more portions sandwich a portion in which the average number of aggregate phase per imaginary line is larger, by less than 5, than the minimum average number of aggregate phase per imaginary line.

In the spark plug of configuration 1, the distance between the forward end of the terminal electrode and the rear end of the center electrode in the direction of the axial line is 15 mm or more. In such a case, generally, there is a concern that the density of the resistor is lowered.

However, according to the spark plug of configuration 1, when the average number of aggregate phase per imaginary line is determined in a line group, there are three or more consecutive line groups wherein the average number of aggregate phase per imaginary line for each of a plurality of line groups is larger, by 5 or more, than the minimum average number of aggregate phase per imaginary line among the plurality of line groups (as used herein, the term "fine portion" refers to a portion of the resistor in which there are three or more consecutive line groups which satisfy the condition that the average number of aggregate phase per imaginary line is larger, by 5 or more, than the minimum average number of aggregate phase per imaginary line among the plurality of line groups). Specifically, the resistor has a portion (coarse portion) including aggregate phase (glass powder) having a relatively large mean grain size, and a portion (fine portion) including aggregate phase (glass powder) having a relatively small mean grain size, wherein the fine portion has a sufficiently large thickness in the direction of the axial line (i.e., the fine portion has a sufficiently large volume). Therefore, during formation of the resistor through heating, a large amount of a $B_2O_3$-rich glass component (glass component forming the intervening phase) is melted from the fine portion containing glass powder of relatively small mean particle size, and the glass component enters between aggregate phase of the coarse portion, whereby gaps between the aggregate phase of the coarse portion can be filled with the intervening phase. Thus, generation of voids between the aggregate phase can be suppressed, and the density of the resistor can be sufficiently increased. Consequently, in combination with the distance between the forward end of the terminal electrode and the rear end of the center electrode in the direction of the axial line being 15 mm or more (i.e., the resistor has a relatively large length), an increase in density of the resistor realizes very excellent load life performance.

Incidentally, in order for the glass material to be melted easily during formation of the resistor, the composition of the glass material may be modified in a portion of the resistor. However, when the composition of the glass material is modified in a portion of the resistor, difficulty is encountered in forming the intervening phase into a fine network shape. Therefore, the number of electrically conductive paths may be reduced in the resistor, resulting in failure to sufficiently improve load life performance.

In contrast, according to the spark plug of configuration 1, easy melting of the glass material is achieved through adjustment of the particle size of glass powder, rather than through modification of the composition of the glass material. Therefore, the intervening phase can be more reliably formed into a fine network shape, and a large number of electrically conductive paths can be more reliably formed. Consequently, excellent load life performance can be reliably realized in the resistor.

According to the spark plug of configuration 2, the length of the resistor in the direction of the axial line is 50% or more of the distance between the forward end of the terminal electrode and the rear end of the center electrode in the direction of the axial line. Therefore, the resistor has a sufficiently large length, and radio-noise-preventing effect can be further improved.

Meanwhile, when the length of the resistor in the direction of the axial line is 50% or more of the distance between the forward end of the terminal electrode and the rear end of the center electrode in the direction of the axial line, pressure is less likely to be applied to a forward end portion of the resistor (resistor composition). Therefore, the density of the resistor may be lowered, and load life performance may be deteriorated.

However, in the case where the aforementioned configuration 1 is employed, even when the resistor has a relatively large length (i.e., the spark plug of configuration 2), the density of the resistor can be sufficiently increased. In other words, the aforementioned configuration 1 is particularly effective for a spark plug in which, for improvement of radio-noise-preventing effect, the length of the resistor in the direction of the axial line is adjusted to 50% or more of the distance between the forward end of the terminal electrode and the rear end of the center electrode in the direction of the axial line.

In recent years, demand has arisen for reduction in size of a spark plug, and accordingly the inner diameter of a portion of the axial hole where the resistor is provided may be reduced to a relatively small value. However, when the inner diameter of the axial hole is small as described above, pressure is less likely to be applied to a forward end portion of the resistor (resistor composition). Therefore, the density of the resistor may be lowered, and load life performance may be deteriorated.

In contrast, in the case where the aforementioned configuration 1 is employed, even when the axial hole has an inner diameter of 3.5 mm or less at the forward end of a region thereof in which only the resistor is present (i.e., the spark plug of configuration 3), the density of the resistor can be sufficiently increased. In other words, the aforementioned configuration 1 is particularly effective for a spark plug in which the inner diameter of the axial hole is 3.5 mm or less.

When the axial hole has an inner diameter of 2.9 mm or less at the forward end of a region thereof in which only the resistor is present (i.e., the spark plug of configuration 4), there may be a further concern that the density of the resistor is lowered, but such a concern can be eliminated through employment of the aforementioned configuration 1. In other words, the aforementioned configuration 1 is very effective for a spark plug in which the inner diameter of the axial hole is 2.9 mm or less.

According to the spark plug of configuration 5, the distance between the forward end of the terminal electrode and the rear end of the center electrode in the direction of the axial line is 17 mm or more. Thus, the resistor can be further lengthened, and radio-noise-preventing effect can be further improved.

When the aforementioned distance is 17 mm or more, since pressure is much less likely to be applied to a forward end portion of the resistor (resistor composition), there may be a further concern that load life performance is deteriorated. However, such a concern can be eliminated through employment of the aforementioned configuration 1. In other words, the aforementioned configuration 1 is particularly effective for a spark plug in which the aforementioned distance is adjusted to 17 mm or more for further improvement of radio-noise-preventing effect.

According to the spark plug of configuration 6, two or more fine portions are provided so as to sandwich a coarse portion. Therefore, in the coarse portion, gaps between aggregate phase can be more reliably filled with an intervening phase, and generation of voids can be considerably suppressed between the aggregate phase. Consequently, the density of the resistor can be further increased, and load life performance can be further improved.

DETAILED DESCRIPTION OF THE PREFERRED EMBODIMENTS

Figure 1:
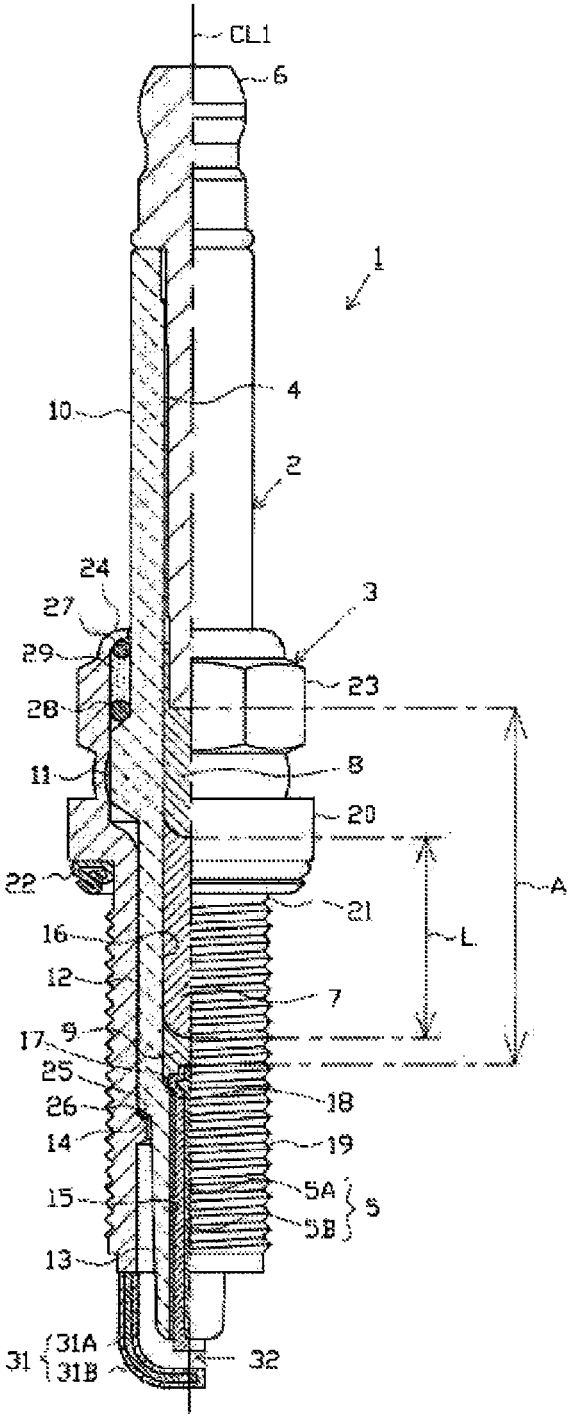
FIG. 1 is a partially sectioned front view of the configuration of a spark plug.

One embodiment will next be described with reference to the drawings. FIG. 1 is a partially sectioned front view of a spark plug 1. In FIG. 1, the direction of an axial line CL1 of the spark plug 1 is referred to as the vertical direction. In the following description, the lower side of the spark plug 1 in FIG. 1 is referred to as the forward end side of the spark plug 1, and the upper side as the rear end side.

The spark plug 1 includes a tubular ceramic insulator 2, and a tubular metallic shell 3 which holds the insulator 2 therein.

The ceramic insulator 2 is formed from alumina or the like through firing, as well known in the art. The ceramic insulator 2, as viewed externally, includes a rear trunk portion 10 formed on the rear end side; a large-diameter portion 11 which is located forward of the rear trunk portion 10 and projects outwardly in a radial direction; an intervening trunk portion 12 which is located forward of the large-diameter portion 11 and is smaller in diameter than the large-diameter portion 11; and a leg portion 13 which is located forward of the intervening trunk portion 12 and is smaller in diameter than the intervening trunk portion 12. The large-diameter portion 11, the intervening trunk portion 12, and most of the leg portion 13 of the ceramic insulator 2 are accommodated in the metallic shell 3. In addition, a tapered portion 14 is formed at a connection portion between the intervening trunk portion 12 and the leg portion 13 such that the diameter of the tapered portion 14 decreases toward the forward end. The ceramic insulator 2 seats on the metallic shell 3 by means of the tapered portion 14.

Furthermore, the ceramic insulator 2 has an axial hole 4 extending therethrough along the axial line CL1. The axial hole 4 has, at the forward end thereof, a small-diameter portion 15, and also has a large-diameter portion 16 which is located rearward of the small-diameter portion 15 and is larger in inner diameter than the small-diameter portion 15. A tapered stepped portion 17 is provided between the small-diameter portion 15 and the large-diameter portion 16.

In addition, a center electrode 5 is inserted in and fixed to the forward end portion (small-diameter portion 15) of the axial hole 4. More specifically, the center electrode 5 has, at the rear end thereof, a protrusion 18 which protrudes outwardly, and the center electrode 5 is fixed in the axial hole 4 such that the protrusion 18 seats on the stepped portion 17. The center electrode 5 includes an inner layer 5A formed of copper or a copper alloy, and an outer layer 5B formed of an alloy containing nickel (Ni) as a main component. The center electrode 5 generally assumes a rod shape (circular columnar shape), and a forward end portion thereof projects from the forward end of the ceramic insulator 2.

Also, a terminal electrode 6 is inserted in and fixed to the rear end portion (large-diameter portion 16) of the axial hole 4 and projects from the rear end of the ceramic insulator 2. The distance A between the forward end of the terminal electrode 6 and the rear end of the center electrode 5 in the direction of the axial line CL1 is 15 mm or more (17 mm or more in the present embodiment).

A circular columnar, electrically conductive resistor 7 is provided within the axial hole 4 between the center electrode 5 and the terminal electrode 6. The resistor 7 is provided for the purpose of reducing radio noise. The resistance of the resistor 7 may vary with the specification of the spark plug, and is, for example, 100Ω or more. The resistor 7 is formed through heat-sealing of a resistor composition containing, for example, an electrically conductive material (e.g., carbon black), glass powder containing silicon dioxide ($SiO_2$) and boron oxide ($B_2O_3$), and ceramic particles [e.g., zirconium oxide ($ZrO_2$) particles or titanium oxide ($TiO_2$) particles] (the configuration of the resistor 7 will be described in detail hereinbelow). Opposite end portions of the resistor 7 are electrically connected to the center electrode 5 and the terminal electrode 6, respectively, via electrically conductive (e.g., a resistance of about several hundreds of mΩ) glass sealing layers 8 and 9.

The metallic shell 3 is formed of a metal (e.g., low-carbon steel) and assumes a tubular shape. The metallic shell 3 has, on an outer wall thereof, a threaded portion (externally threaded portion) 19 adapted to mount the spark plug 1 in an attachment hole of a combustion apparatus (e.g., an internal combustion engine or a fuel cell reformer). Also, the metallic shell 3 has thereon a flange-like seat portion 20 which is located rearward of the threaded portion 19. A ring-like gasket 22 is fitted onto a screw neck 21 at the rear end of the threaded portion 19. Furthermore, the metallic shell 3 has, on a rear end portion thereof, a tool engagement portion 23 having a hexagonal cross section for engaging a tool (e.g., a wrench) with the portion 23 during mounting of the metallic shell 3 on the combustion apparatus, and also has, at the rear end thereof, a crimp portion 24 for holding the ceramic insulator 2.

In the present embodiment, in order to reduce the diameter (size) of the spark plug 1, the ceramic insulator 2 and the metallic shell 3 have a relatively small diameter, and the threaded portion 19 has a relatively small diameter (e.g., M12 or less).

The metallic shell 3 has, on a forward-end-side inner wall thereof, a tapered stepped portion 25 on which the ceramic insulator 2 seats. The ceramic insulator 2 is inserted forward into the metallic shell 3 from the rear end of the metallic shell 3. While the tapered portion 14 of the ceramic insulator 2 seats on the stepped portion 25 of the metallic shell 3, a rear opening portion of the metallic shell 3 is crimped inwardly in a radial direction; i.e., the aforementioned crimp portion 24 is formed, whereby the ceramic insulator 2 is fixed to the metallic shell 3. An annular seat packing 26 is provided between the tapered portion 14 and the stepped portion 25. The seat packing 26 maintains the gas tightness of a combustion chamber, and prevents outward leakage of a fuel gas which enters the clearance between the inner wall of the metallic shell 3 and the leg portion 13 of the ceramic insulator 2, which is exposed to the combustion chamber.

Furthermore, in order to achieve more reliable gas tightness through crimping, annular ring members 27 and 28 are provided between the metallic shell 3 and the ceramic insulator 2 at a rear end portion of the metallic shell 3, and a space between the ring members 27 and 28 is filled with powder of talc 29. That is, the metallic shell 3 holds the ceramic insulator 2 via the seat packing 26, the ring members 27 and 28, and the talc 29.

A ground electrode 31 is bonded to the forward end of the metallic shell 3 such that the ground electrode 31 is bent at an intervening portion thereof, and a distal side surface of the ground electrode 31 faces a forward end portion of the center electrode 5. The ground electrode 31 includes an outer layer 31A formed of an alloy containing Ni as a main component, and an inner layer 31B formed of a metal having thermal conductivity higher than that of the Ni alloy (e.g., a copper alloy or pure copper).

Also, a gap 32 is provided between the forward end portion of the center electrode 5 and the distal end portion of the ground electrode 31, and spark discharge occurs at the gap 32 generally in a direction along the axial line CL1.

Figure 2A:
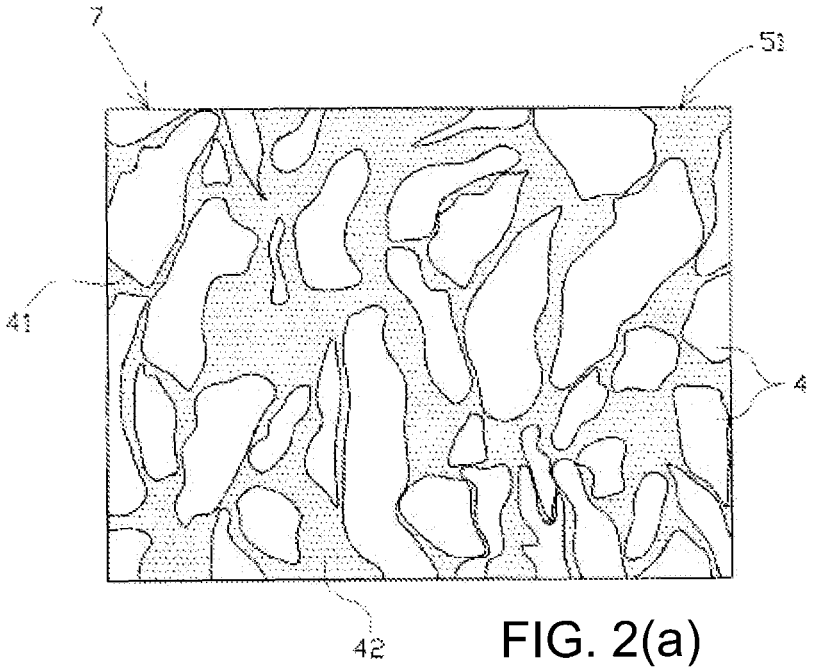
FIG. 2(*a*) is a schematic enlarged cross-sectional view of the structure of a coarse portion, and FIG. 2(*b*) is a schematic enlarged cross-sectional view of the structure of a fine portion.
Figure 2B:
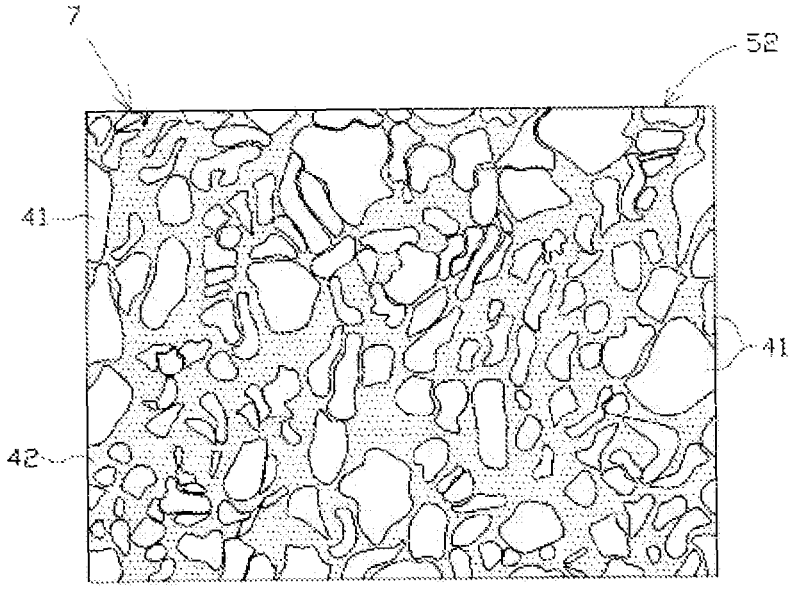

Next will be described the configuration of the resistor 7 in detail. As described above, the resistor 7 is formed through heat-sealing of a resistor composition containing an electrically conductive material, glass powder, and ceramic particles; i.e., the resistor 7 contains an electrically conductive material and glass. As shown in FIGS. 2(*a*) and 2(*b*), the resistor 7 has aggregate phase 41 containing $SiO_2$, and an intervening phase 42 which is present around the aggregate phase 41 (the intervening phase 42 corresponds to a dotted region shown in FIG. 2).

The aggregate phase 41 is formed of glass grains from which a $B_2O_3$-rich glass component has been melted, and the $SiO_2$ content of the aggregate phase 41 is higher than that of the intervening phase 42. Meanwhile, the intervening phase 42 is mainly formed of a $B_2O_3$-rich glass component melted from the glass powder, and the $B_2O_3$ content of the intervening phase 42 is higher than that of the aggregate phase 41. The intervening phase 42 contains therein the electrically conductive material and ceramic grains.

Between the center electrode 5 and the terminal electrode 6, current flows through the intervening phase 42 containing the electrically conductive material. As viewed in cross section of the resistor 7, the intervening phase 42 is in a fine network form by the presence of the aggregate phase 41. In the intervening phase 42, an electrically conductive path formed of the electrically conductive material is finely divided by the presence of the glass component or the ceramic grains. That is, the electrically conductive path of the resistor 7 is very finely branched by the presence of, for example, the aggregate phase 41 or the ceramic grains.

Figure 3:
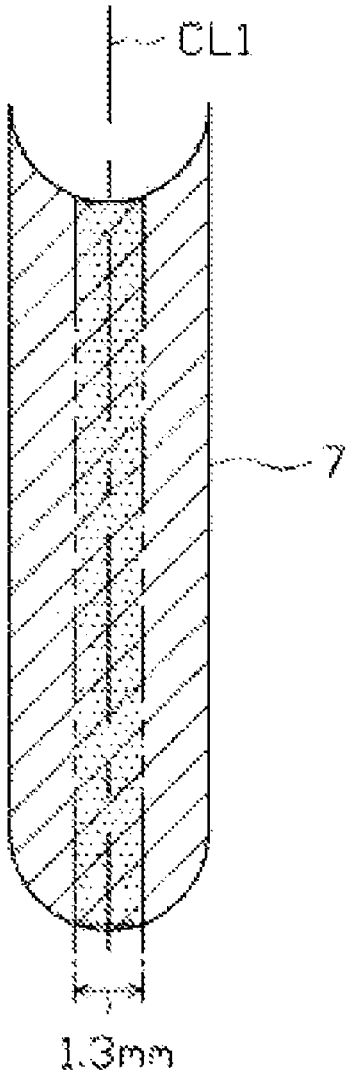
FIG. 3 is a partially enlarged cross-sectional view of a resistor.
Figure 4:
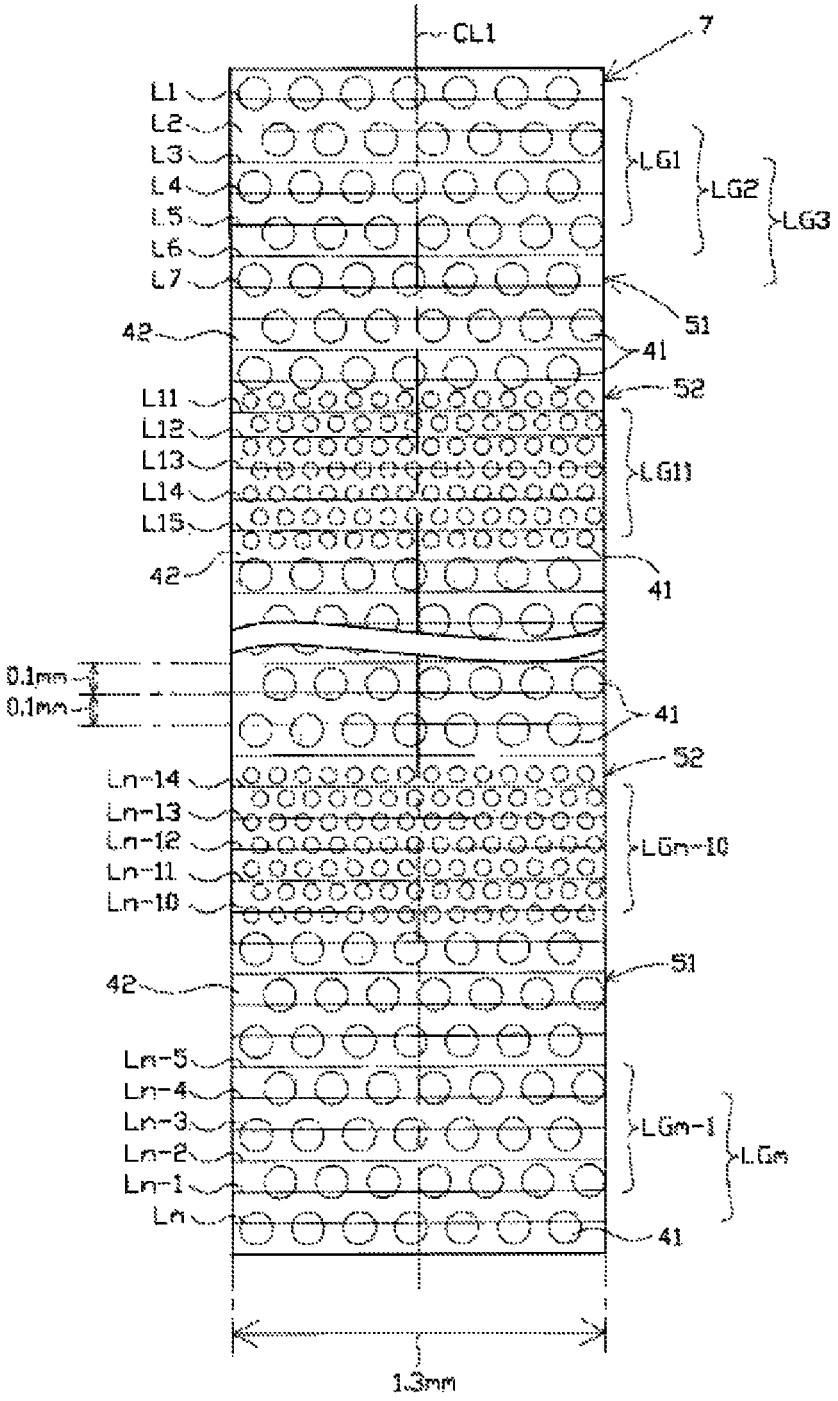
FIG. 4 is a schematic cross-sectional view of the resistor for describing a method for determining the average number of aggregate phase in each line group.
Figure 5:
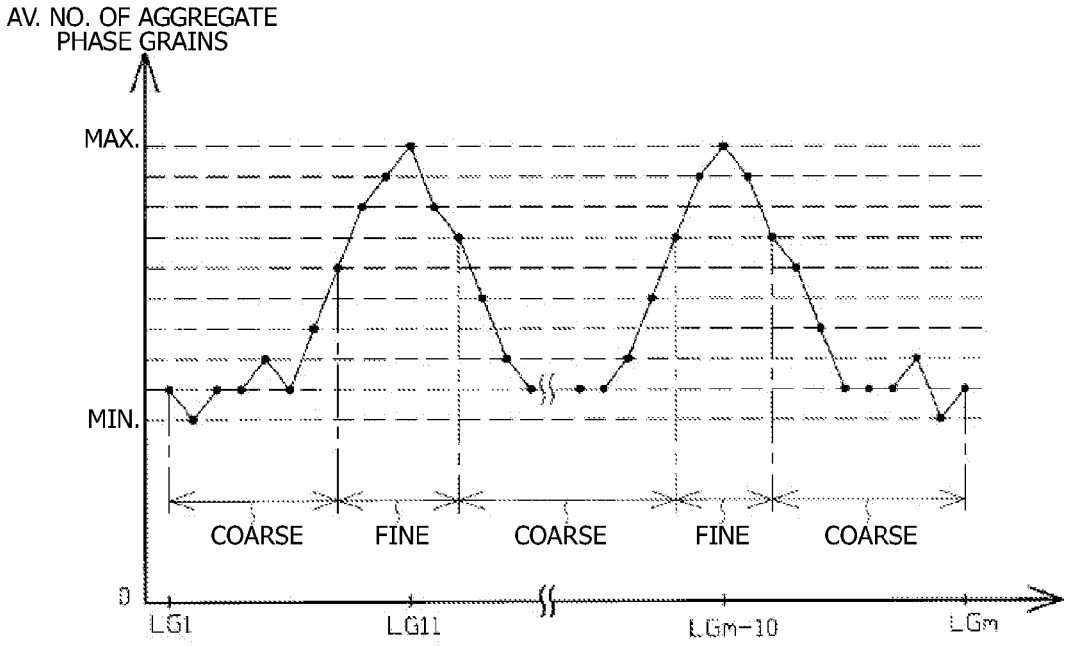
FIG. 5 is a graph showing the average number of aggregate phase in each line group.

In the present embodiment, the aggregate phase 41, which are shown in a cross section including the axial line CL1, are formed in the resistor 7 as follows. Specifically, FIG. 3 (note: FIG. 3 shows only the resistor 7) shows a cross section of the resistor 7, the cross section including the axial line CL1, and having a portion (dotted portion shown in FIG. 3) whose center corresponds to the axial line CL1 and which has a width of 1.3 mm in a direction perpendicular to the axial line CL1. As shown in FIG. 4 (note: FIG. 4 schematically shows the aggregate phase 41 as circles having diameters corresponding to the grain sizes), in the aforementioned cross section, a plurality of imaginary lines (L1, L2, . . . $L_{n-1}$, $L_1$) perpendicular to the axial line CL1 are drawn at intervals of 0.1 mm in the direction of the axial line CL1, and the number of aggregate phase 41 located on each of the imaginary lines (L1, L2, . . . $L_{n-1}$, $L_n$) is determined. Subsequently, as shown in FIG. 5, the average number of aggregate phase 41 per imaginary line is determined in each of line groups (LG1, LG2, . . . $LG_{m-1}$, $LG_m$) each group consisting of five consecutive imaginary lines. In the present embodiment, the resistor 7 is configured such that there are three or more consecutive line groups which satisfy the condition that the average number of aggregate phase 41 per imaginary line is larger, by 5 or more, than the minimum average number of aggregate phase 41 per imaginary line among the plurality of line groups.

Specifically, in the present embodiment, the resistor 7 has a coarse portion 51 as shown in FIG. 2(*a*) in which aggregate phase 41 has a relatively large mean grain size and the average number of aggregate phase 41 is relatively small, and a fine portion 52 as shown in FIG. 2(*b*) in which aggregate phase 41 has a relatively small mean grain size and the average number of aggregate phase 41 is relatively large. Also, in the resistor 7, the fine portion 52 has a sufficiently large thickness in the direction of the axial line CL1 (i.e., the fine portion 52 has a sufficiently large volume). In the resistor 7, the fine portion 52 corresponds to a portion in which there are three or more consecutive line groups which satisfy the condition that the average number of aggregate phase per imaginary line is larger, by 5 or more, than the minimum average number of aggregate phase per imaginary line among the plurality of line groups.

Figure 6:
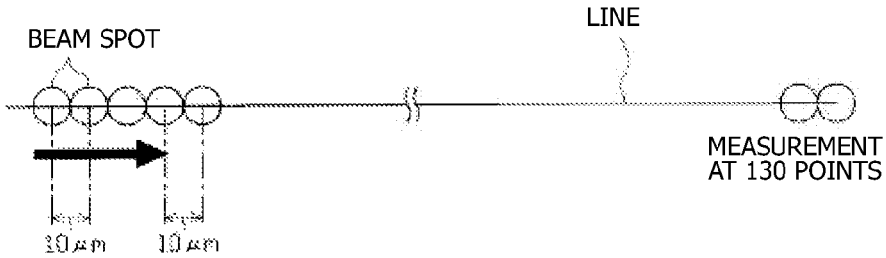
FIG. 6 illustrates a method for determining the number of aggregate phase.

The number of aggregate phase 41 on each imaginary line can be determined as follows. Specifically, as shown in FIG. 6, the Si content of a total of 130 points (which are on each of the aforementioned imaginary lines at intervals of 10 μm) is determined by means of an EPMA (electron probe micro analyzer) under the following conditions: acceleration voltage: 20 kV, irradiation current: $5\pm0.5\times10^{-8}$ A, irradiation beam diameter: 10 μm, effective time (acquisition time): 10 ms. Then, the peak value of the thus-determined Si content is determined, and points in which the Si content is 60% or more of the peak value are specified. Subsequently, the number of points in which the Si content is 60% or more of the peak value is counted, and the number of the points is regarded as the number of aggregation phase grains 41 on the line. When points in which the Si content is 60% or more of the peak value are adjacent to each other, the number of aggregation phase grains 41 is determined by regarding a group of the adjacent points as one point.

Furthermore, in the present embodiment, a fine portion 52 is located between coarse portions 51, and two or more fine portions 52 are present. That is, there are two or more portions each including three or more consecutive line groups which satisfy the condition that the average number of aggregate phase per imaginary line is larger, by 5 or more, than the minimum average number of aggregate phase per imaginary line, and the two or more portions sandwich a portion which satisfy the condition that the average number of aggregate phase per imaginary line is larger, by less than 5, than the minimum average number of aggregate phase per imaginary line among the plurality of line groups.

Figure 7:
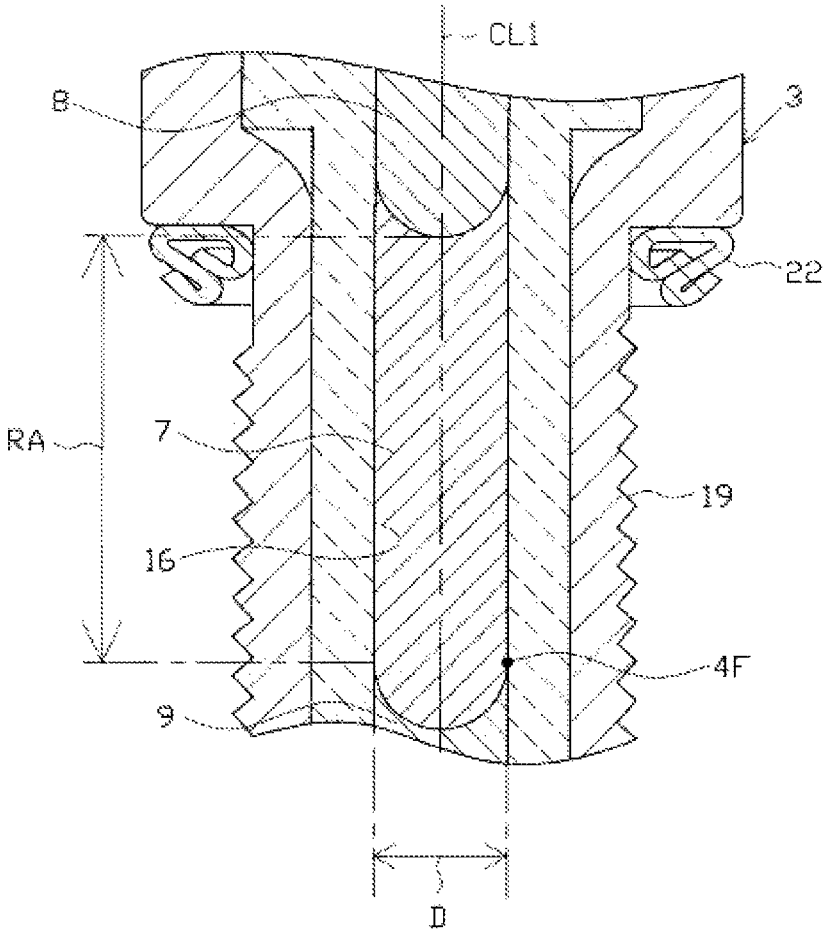
FIG. 7 is an enlarged cross-sectional view of an axial hole, and shows the maximum inner diameter of a portion of the axial hole where a resistor is provided.

Also, in the present embodiment, as shown in FIG. 7 (i.e., a cross section perpendicular to the axial line CL1), in association with a reduction in size of the ceramic insulator 2, the inner diameter D of the axial hole 4 (large-diameter portion 16) is adjusted to 3.5 mm or less (2.9 mm or less in the present embodiment) at the forward end 4F of a region RA in the axial hole 4 along the axial line CL1 in which only the resistor 7 is present; i.e., the resistor 7 has a relatively small diameter.

In the cross section perpendicular to the axial line CL1, the region RA in the axial hole 4 along the axial line CL1 in which only the resistor 7 is present can be specified by means of a perspective image taken by, for example, a micro CT scanner [product name: TOSCANER (registered trademark), product of TOSHIBA].

As shown in FIG. 1, the length L of the resistor 7 in the direction of the axial line CL1 is 50% or more of the aforementioned distance A; i.e., the resistor 7 has a relatively large length.

Next will be described a method for producing the spark plug 1 having the aforementioned configuration.

Firstly, the metallic shell 3 is produced in advance. Specifically, a circular columnar metal material (e.g., an iron material such as S17C or S25C, or a stainless steel material) is subjected to cold forging so as to provide a through hole therein and to impart a rough shape thereto. Thereafter, the resultant product is subjected to machining for shaping, to thereby produce a metallic shell intervening.

Subsequently, the ground electrode 31 formed of an Ni alloy or the like is bonded to the forward end surface of the metallic shell intervening through resistance welding. During this welding process, so-called "roll off" occurs. Therefore, after removal of a "roll-off" portion, the threaded portion 19 is formed on a specific position of the metallic shell intervening by thread rolling. Thus, the metallic shell 3 having the ground electrode 31 welded thereto is produced. Then, the metallic shell 3 having the ground electrode 31 welded thereto is subjected to zinc plating or nickel plating. For improvement of corrosion resistance, the thus-plated surface may be further subjected to chromate treatment.

Meanwhile, separately from the metallic shell 3, the ceramic insulator 2 is formed through molding. For example, a granular material for molding is prepared from a powdery raw material predominantly containing alumina and also containing a binder or the like, and the granular material is subjected to rubber press molding, to thereby produce a tubular molded product. The molded product is subjected to grinding for shaping, and the thus-shaped molded product is fired in a firing furnace, to thereby form the ceramic insulator 2.

The center electrode 5 is produced separately from the metallic shell 3 and the ceramic insulator 2. Specifically, the center electrode 5 is produced through forging of an Ni alloy body including, in the center thereof, a copper alloy or the like for improving heat radiation property.

In addition, a powdery resistor composition is prepared for formation of the resistor 7. In the present embodiment, two types of resistor compositions (a first resistor composition and a second resistor composition) are provided. More specifically, firstly, carbon black, ceramic particles, and a specific binder are mixed together, and the mixture is mixed with water serving as a medium. A slurry prepared through mixing is dried, and the dried slurry is mixed under stirring with $SiO_2$—$B_2O_3$—BaO—$Li_2O$ glass powder having a relatively large mean particle size (e.g., a mean particle size of about 300 μm to about 400 μm), to thereby prepare a first resistor composition. The above-dried slurry is mixed under stifling with the aforementioned glass powder having a relatively small mean particle size (e.g., a mean particle size of about 100 μm), to thereby prepare a second resistor composition.

Subsequently, the above-produced ceramic insulator 2 and center electrode 5, the resistor 7, and the terminal electrode 6 are seal-fixed by means of the glass sealing layers 8 and 9. More specifically, firstly, the center electrode 5 is inserted into the small-diameter portion 15 of the axial hole 4 so that the protrusion 18 of the center electrode 5 seats on the stepped portion 17 of the axial hole 4. Next, the axial hole 4 is charged with electrically conductive glass powder which has generally been prepared through mixing of borosilicate glass and metal powder, and the thus-charged electrically conductive glass powder is preliminarily compressed. Then, the axial hole 4 is charged with the first and second resistor compositions so that the second resistor composition is located between the first resistor compositions, and the thus-charged compositions are preliminarily compressed in the same manner as described above. Furthermore, the axial hole 4 is charged with the aforementioned electrically conductive glass powder, and the glass powder is preliminarily compressed in the same manner as described above. Then, the terminal electrode 6 is inserted through the rear-end-side opening of the axial hole 4. While the first and second resistor compositions and the electrically conductive glass powder are pressed toward the forward end in the direction of the axial line CL1 by means of the terminal electrode 6, the resistor compositions and the electrically conductive glass powder are heated in a firing furnace at a specific target temperature (e.g., 900° C.) which is equal to or higher than the glass softening point.

The above-stacked resistor compositions and electrically conductive glass powder respectively become the resistor 7 and the glass sealing layers 8 and 9 through thermal compression, and the center electrode 5, the terminal electrode 6, and the resistor 7 are seal-fixed to the ceramic insulator 2 by means of the glass sealing layers 8 and 9.

The formation process of the resistor 7 will now be described in detail. During heating, a $B_2O_3$-rich glass component is melted from the glass powder of the resistor composition, and the resultant $SiO_2$-rich glass powder forms aggregate phase 41 of relatively high viscosity.

Then, an intervening phase 42 of relatively low viscosity formed from the $B_2O_3$-rich glass component enters gaps (pores) between the aggregate phase 41. In the second resistor composition containing the glass powder having a relatively small mean particle size, the glass powder is readily melted, and the $B_2O_3$-rich glass component is readily melted from the glass powder, as compared with the case of the first resistor composition. Therefore, gaps between the aggregate phase 41 (not only on the second resistor composition side, but also on the first resistor composition side) are more reliably filled with the $B_2O_3$-rich glass component (intervening phase) melted from the second resistor composition.

Thereafter, the ceramic insulator 2 having, for example, the above-produced center electrode 5 and resistor 7 is fixed to the metallic shell 3 having the ground electrode 31. More specifically, the ceramic insulator 2 is inserted into the metallic shell 3, and a relatively thin rear-end-side opening portion of the metallic shell 3 is crimped inwardly in a radial direction; i.e., the aforementioned crimp portion 24 is formed, whereby the ceramic insulator 2 is fixed to the metallic shell 3.

Finally, the ground electrode 31 is bent, and the size of the gap 32 provided between the center electrode 5 and the ground electrode 31 is adjusted, to thereby produce the aforementioned spark plug 1.

As described above in detail, in the present embodiment, when the average number of aggregate phase 41 per imaginary line is determined in each of the line groups (LG1, LG2, . . . $LG_{m-1}$, $LG_m$), there are three or more consecutive line groups wherein the average number of aggregate phase 41 per imaginary line is larger, by 5 or more, than the minimum average number of aggregate phase 41 per imaginary line among the line groups. Specifically, the resistor 7 has the coarse portion 51 and the fine portion 52, and the fine portion 52 has a sufficiently large thickness in the direction of the axial line CL1 (i.e., the fine portion 52 has a sufficiently large volume). Therefore, during formation of the resistor 7 through heating, a large amount of a $B_2O_3$-rich glass component (glass component forming the intervening phase 42) is melted from the fine portion 52 (the second resistor composition) containing glass powder of relatively small mean particle size, and the glass component enters between the aggregate phase 41 of the coarse portion 51 (the first resistor composition), whereby gaps between the aggregate phase 41 of the coarse portion 51 can be filled with the intervening phase 42. Thus, generation of voids between the aggregate phase 41 can be suppressed in both of the coarse portion 51 and the fine portion 52, and the density of the resistor 7 can be sufficiently increased. Consequently, in combination with the aforementioned distance A being 15 mm or more (i.e., the resistor 7 has a relatively large length), an increase in density of the resistor 7 realizes very high load life performance.

Furthermore, in the present embodiment, the length L of the resistor 7 in the direction of the axial line CL1 is 50% or more of the aforementioned distance A; i.e., the ratio (L/A) is 50% or more. Therefore, the resistor 7 has a sufficiently large length, and radio-noise-preventing effect can be further improved. In the present embodiment, since the distance A is adjusted to 17 mm or more, load life performance can be further improved.

In addition, in this embodiment, two or more fine portions 52 are provided so as to sandwich the coarse portion 51. Therefore, in the coarse portion 51, gaps between the aggregate phase 41 can be more reliably filled with the intervening phase 42, and generation of voids between the aggregate phase 41 can be considerably suppressed. Consequently, the density of the resistor 7 can be further increased, and load life performance can be further improved.

When, in the spark plug 1, the ratio L/A is adjusted to 50% or more, the distance A is adjusted to 15 mm or more (17 mm or more), or the aforementioned inner diameter D is adjusted to 3.5 mm or less (2.9 mm or less) as in the case of the present embodiment, generally, there may be a concern that the density of the resistor is likely to be lowered, resulting in deterioration of load life performance. However, according to the present embodiment, such a concern can be eliminated.

In order to determine the effects exerted by the aforementioned embodiment, spark plug samples were prepared by varying the inner diameter D, the distance A, the difference between the maximum average number of the aggregate phase and the minimum average number thereof, the number of fine portions, and the ratio of the length L to the distance A (L/A). Each of the samples was subjected to a load life performance evaluation test and a radio noise performance evaluation test.

The load life performance evaluation test was carried out as follows. Specifically, each sample was attached to a transistor ignition device for an automobile, and discharge was carried out 3,600 times per minute at a temperature of 350° C. and a discharge voltage of 20 kV, followed by measurement of a time (lifetime) until the resistance at ambient temperature reached 100 kΩ or more. For evaluation of the load life performance of each sample, score (1 to 10) was assigned to the sample according to the measured lifetime thereof. Specifically, score "1" was assigned to a sample exhibiting a lifetime of less than 10 hours; score "2" was assigned to a sample exhibiting a lifetime of 10 hours or more and less than 20 hours; score "3" was assigned to a sample exhibiting a lifetime of 20 hours or more and less than 100 hours; score "4" was assigned to a sample exhibiting a lifetime of 100 hours or more and less than 120 hours; and score "5" was assigned to a sample exhibiting a lifetime of 120 hours or more and less than 140 hours. Thus, one-point-elevated score was assigned as the lifetime increased by 20 hours (e.g., score "7" was assigned to a sample exhibiting a lifetime of 160 hours or more and less than 180 hours). Score "10" was assigned to a sample exhibiting a lifetime of 220 hours or more. Rating "0" was assigned to a sample in which score was 7 or more; i.e., a sample exhibiting excellent load life performance, whereas rating "X" was assigned to a sample in which score was 6 or less; i.e., a sample exhibiting poor load life performance.

The radio noise performance evaluation test was carried out as follows. Specifically, five samples (having almost the same resistance: 5±0.3Ω) were prepared so as to correspond to each of the above-prepared samples. Subsequently, each sample was subjected to the radio noise evaluation test according to JASO D002-2, and the average of values corresponding to the radio-noise-preventing effect (i.e., radio-noise-preventing performance) of each sample was determined. Among the thus-determined averages, the radio-noise-preventing performance at 300 MHz was employed for comparison. On the basis of the radio-noise-preventing performance of sample No. 17 shown below in Table 1, score (1 to 10) was assigned to each sample according to the degree of improvement in radio-noise-preventing performance. Specifically, score "1" was assigned to a sample in which the degree of improvement was less than 1.0 dB, and score "2" was assigned to a sample in which the degree of improvement was 1.0 dB or more and less than 2.0 dB. Thus, one-point-elevated score was assigned as the degree of improvement increased by 1.0 dB (e.g., score "5" was assigned to a sample in which the degree of improvement was 4.0 dB or more and less than 5.0 dB). Score "10" was assigned to a sample in which the degree of improvement was 9.0 dB or more. Rating "0" was assigned to a sample in which score was 5 or more; i.e., a sample exhibiting an excellent radio-noise-preventing effect, whereas rating "X" was assigned to a sample in which score was 4 or less; i.e., a sample exhibiting a poor radio-noise-preventing effect.

Table 1 shows the results of both of the aforementioned tests for each sample. The number of aggregate phase was counted by means of EPMA (electron probe microanalyzer) in the aforementioned manner after mirror polishing. When aggregate phase were welded together, the welded aggregate phase was not separated from one another and was counted as one aggregate phase grain. The resistor was basically formed from a first resistor composition containing glass powder having a mean particle size of about 300 μm to about 400 μm. However, in the case where the resistor was formed so as to have a fine portion, the fine portion was formed from a second resistor composition (0.01 g) containing glass powder having a mean particle size of about 100 μm.

TABLE 1

| Sample | Inner diameter D (mm) | Distance A (mm) | Difference between maximum average number and minimum average number | Number of fine portions | L/A (%) | Load life performance evaluation | | Radio noise prevention evaluation | |
|---|---|---|---|---|---|---|---|---|---|
| 1 | 4.0 | 10.0 | 2 | 0 | 50 | 7 | ○ | 1 | X |
| 2 | 4.0 | 15.0 | 2 | 0 | 50 | 5 | X | 5 | ○ |
| 3 | 4.0 | 17.0 | 2 | 0 | 50 | 4 | X | 7 | ○ |
| 4 | 4.0 | 20.0 | 2 | 0 | 50 | 4 | X | 8 | ○ |
| 5 | 4.0 | 10.0 | 5 | 1 | 50 | 7 | ○ | 1 | X |
| 6 | 4.0 | 15.0 | 5 | 1 | 50 | 7 | ○ | 5 | ○ |
| 7 | 4.0 | 17.0 | 5 | 1 | 50 | 7 | ○ | 7 | ○ |
| 8 | 4.0 | 20.0 | 5 | 1 | 50 | 7 | ○ | 8 | ○ |
| 9 | 4.0 | 10.0 | 2 | 0 | 60 | 7 | ○ | 3 | X |
| 10 | 4.0 | 15.0 | 2 | 0 | 60 | 2 | X | 7 | ○ |
| 11 | 4.0 | 17.0 | 2 | 0 | 60 | 1 | X | 9 | ○ |
| 12 | 4.0 | 20.0 | 2 | 0 | 60 | 1 | X | 10 | ○ |
| 13 | 4.0 | 10.0 | 5 | 1 | 60 | 7 | ○ | 3 | X |
| 14 | 4.0 | 15.0 | 5 | 1 | 60 | 7 | ○ | 7 | ○ |
| 15 | 4.0 | 17.0 | 5 | 1 | 60 | 7 | ○ | 9 | ○ |
| 16 | 4.0 | 20.0 | 5 | 1 | 60 | 7 | ○ | 10 | ○ |
| 17 | 3.5 | 10.0 | 2 | 0 | 50 | 7 | ○ | 1 | X |
| 18 | 3.5 | 15.0 | 2 | 0 | 50 | 3 | X | 5 | ○ |
| 19 | 3.5 | 20.0 | 2 | 0 | 50 | 2 | X | 8 | ○ |
| 20 | 3.5 | 10.0 | 5 | 1 | 50 | 7 | ○ | 1 | X |
| 21 | 3.5 | 15.0 | 5 | 1 | 50 | 7 | ○ | 5 | ○ |
| 22 | 3.5 | 20.0 | 5 | 1 | 50 | 7 | ○ | 8 | ○ |
| 23 | 2.9 | 10.0 | 2 | 0 | 50 | 7 | ○ | 1 | X |
| 24 | 2.9 | 15.0 | 2 | 0 | 50 | 2 | X | 5 | ○ |
| 25 | 2.9 | 17.0 | 2 | 0 | 50 | 1 | X | 8 | ○ |
| 26 | 2.9 | 10.0 | 5 | 1 | 50 | 7 | ○ | 1 | X |
| 27 | 2.9 | 15.0 | 5 | 1 | 50 | 7 | ○ | 5 | ○ |
| 28 | 2.9 | 17.0 | 5 | 1 | 50 | 7 | ○ | 8 | ○ |
| 29 | 4.0 | 17.0 | 5 | 2 | 60 | 8 | ○ | 9 | ○ |
| 30 | 4.0 | 20.0 | 5 | 2 | 60 | 8 | ○ | 10 | ○ |
| 31 | 3.5 | 10.0 | 8 | 1 | 50 | 7 | ○ | 1 | X |
| 32 | 3.5 | 15.0 | 8 | 1 | 50 | 7 | ○ | 5 | ○ |

TABLE 1-continued

| Sample | Inner diameter D (mm) | Distance A (mm) | Difference between maximum average number and minimum average number | Number of fine portions | L/A (%) | Load life performance evaluation | | Radio noise prevention evaluation | |
|---|---|---|---|---|---|---|---|---|---|
| 33 | 3.5 | 20.0 | 8 | 1 | 50 | 7 | ○ | 8 | ○ |
| 34 | 4.0 | 10.0 | 2 | 0 | 40 | 7 | ○ | 1 | X |
| 35 | 4.0 | 15.0 | 2 | 0 | 40 | 6 | X | 2 | X |

As shown in Table 1, it was found that at least one of load life performance and radio-noise-preventing effect was unsatisfactory in samples in which the distance A was less than 15 mm, or a portion wherein the difference between the maximum average number of aggregate phase and the minimum average number thereof was 5 or more (i.e., a fine portion) was not provided (samples Nos. 1 to 5, 9 to 13, 17 to 20, 23 to 26, 31, 34, and 35). Conceivably, this is attributed to the fact that since the distance A is less than 15 mm (i.e., the resistor has a relatively small length) or no fine portion is provided, the resistance of the resistor rapidly increases through oxidation of a portion of the electrically conductive path.

Comparison between samples in which the inner diameter D and the distance A were the same, and the ratio L/A was varied (samples Nos. 2, 10, and 35) showed that when the ratio L/A was adjusted to 50% or more, radio-noise-preventing effect was further improved, but load life performance was likely to be deteriorated. Conceivably, this is attributed to the fact that when the ratio L/A is adjusted to 50% or more (i.e., the length of the resistor is increased), the density of the resistor is likely to be reduced.

Comparison between samples in which the distance A and the ratio L/A were the same, and the inner diameter D was varied (samples Nos. 2, 18, and 24) showed that when the inner diameter D was smaller, load life performance was more deteriorated. Conceivably, this is attributed to the fact that when the inner diameter D is smaller, pressure is less likely to be transmitted to the resistor composition, and the density of the resistor is likely to be reduced.

In a sample in which the distance A was 17 mm or more (sample No. 3, 11, or 25), radio-noise-preventing effect was further improved, but load life performance was likely to be deteriorated, as compared with the case of a sample in which the distance A was less than 17 mm (sample No. 2, 10, or 24). Conceivably, this is attributed to the fact that when the distance A is larger, pressure is less likely to be transmitted to a forward-end-side portion (in the direction of the axial line) of the resistor composition.

In contrast, it was found that samples in which the distance A was 15 mm or more, and a fine portion was provided (samples Nos. 6 to 8, 14 to 16, 21, 22, 27 to 30, 32, and 33) showed excellent radio-noise-preventing effect and load life performance. Conceivably, this is attributed to the fact that since the distance A is 15 mm or more (i.e., the resistor has a relatively large length), and a fine portion is provided, generation of voids is prevented between aggregate phase, and a large number of electrically conductive paths are formed in the resistor.

As compared with a sample in which one fine portion was provided (sample No. 15 or 16), a sample in which two or more fine portions were provided (sample No. 29 or 30) showed further excellent load life performance. Conceivably, this is attributed to the fact that provision of two or more fine portions further prevents generation of voids between aggregate phase.

When the ratio L/A is adjusted to 50% or more, the inner diameter D is adjusted to 3.5 mm or less, or the distance A is adjusted to 17 mm or more in a sample, there may be a particular concern that the load life performance of the sample is deteriorated. However, when a fine portion was provided in such a sample, the sample was found to exhibit excellent load life performance.

When the inner diameter D is adjusted to 2.9 mm or less, there may be a particular concern that the load life performance of the sample is further deteriorated. However, when such a sample was configured as described above, the sample realized favorable load life performance.

As is clear from the aforementioned test results, preferably, a spark plug is configured such that the distance A is adjusted to 15 mm or more for improving both load life performance and radio-noise-preventing effect, and such that there are three or more consecutive line groups which satisfy the condition that the average number of aggregate phase per imaginary line is larger, by 5 or more, than the minimum average number of aggregate phase per imaginary line among the plurality of line groups.

The above-described configuration is particularly effective for a spark plug in which the ratio L/A is 50% or more (i.e., further improvement of radio-noise-preventing effect is expected), and there is a concern about deterioration of load life performance.

Also, the above-described configuration is particularly effective for a spark plug in which the inner diameter D is adjusted to 3.5 mm or less, and there is a concern about deterioration of load life performance. Meanwhile, the above-described configuration is very effective for a spark plug in which the inner diameter D is adjusted to 2.9 mm or less, and there is a great concern about deterioration of load life performance.

Also, the above-described configuration is particularly effective for a spark plug in which the distance A is adjusted to 17 mm or more (i.e., further improvement of radio-noise-preventing effect is expected), but there is a further concern about deterioration of load life performance.

The present invention is not limited to the above-described embodiment, but may be implemented, for example, as follows. Needless to say, applications and modifications other than those exemplified below are also possible.

(a) In the above-described embodiment, two or more fine portions 52 are provided. However, only one fine portion 52 may be provided.

(b) In the above-described embodiment, the inner diameter D is adjusted to 3.5 mm or less. However, the technical idea of the present invention may be applied to a spark plug in which the inner diameter D exceeds 3.5 mm.

(c) In the above-described embodiment, $ZrO_2$ particles or $TiO_2$ particles are employed as ceramic particles. However, other ceramic particles (e.g., aluminum oxide ($Al_2O_3$) particles) may be employed.

(d) In the above-described embodiment, the present invention is applied to a spark plug in which the ground electrode 31 is bonded to the forward end of the metallic shell 3. However, the present invention may be applied to a spark plug in which its ground electrode is formed, through machining, from a portion of the metallic shell (or a portion of a forward end metal piece welded to the metallic shell in advance) (see, for example, Japanese Patent Application Laid-Open (kokai) No. 2006-236906).

(e) In the above-described embodiment, the tool engagement portion 23 has a hexagonal cross section. However, the shape of the tool engagement portion 23 is not limited thereto. For example, the tool engagement portion 23 may have a Bi-HEX (modified dodecagonal) shape [ISO22977:2005(E)] or the like.

DESCRIPTION OF REFERENCE NUMERALS

1: spark plug
2: ceramic insulator (insulator)
3: metallic shell
4: axial hole
5: center electrode
6: terminal electrode
7: resistor
41: aggregate phase grain
42: intervening phase
CL1: axial line Having described the invention, the following is claimed:

1. A spark plug comprising:

an insulator having an axial hole extending therethrough in a direction of an axial line;

a center electrode inserted into a forward end portion of the axial hole;

a terminal electrode inserted into a rear end portion of the axial hole; and a resistor which is provided within the axial hole between the center electrode and the terminal electrode, said resistor containing an electrically conductive material and a glass containing silicon dioxide and boron oxide, wherein, a distance between the forward end of the terminal electrode and the rear end of the center electrode in the direction of the axial line is 15 mm or more;

the glass is a phase-separated glass having aggregate phase containing silicon dioxide, and an intervening phase provided between the aggregate phase;

the aggregate phase has a silicon dioxide content higher than that of the intervening phase;

the intervening phase has a boron oxide content higher than that of the aggregate phase; and in a cross section of the resistor, the cross section including the axial line, and having a portion whose center corresponds to the axial line and which has a width of 1.3 mm in a direction perpendicular to the axial line, when a plurality of imaginary lines perpendicular to the axial line are drawn at intervals of 0.1 mm in the direction of the axial line, the number of aggregate phase located on each of the imaginary lines is determined, and the average number of aggregate phase per imaginary line is determined for each of a plurality of line groups each consisting of five consecutive imaginary lines, there are three or more consecutive line groups which satisfy the condition that the average number of aggregate phase per imaginary line is larger, by 5 or more, than the minimum average number of aggregate phase per imaginary line among the plurality of line groups.

2. A spark plug according to claim 1, wherein the length of the resistor in the direction of the axial line is 50% or more of the distance between the forward end of the terminal electrode and the rear end of the center electrode in the direction of the axial line.

3. A spark plug according to claim 1 or 2, wherein, in a cross section perpendicular to the axial line, the axial hole has an inner diameter of 3.5 mm or less at the forward end of a region thereof in which only the resistor is present.

4. A spark plug according to claim 1 or 2, wherein, in a cross section perpendicular to the axial line, the axial hole has an inner diameter of 2.9 mm or less at the forward end of a region thereof in which only the resistor is present.

5. A spark plug according to claim 1 or 2, wherein the distance between the forward end of the terminal electrode and the rear end of the center electrode in the direction of the axial line is 17 mm or more.

6. A spark plug according to claim 1 or 2, wherein there are two or more portions each including three or more consecutive line groups which satisfy the condition that the average number of aggregate phase per imaginary line is larger, by 5 or more, than the minimum average number of aggregate phase per imaginary line among the plurality of line groups, and the two or more portions sandwich a portion which satisfy the condition that the average number of aggregate phase per imaginary line is larger, by less than 5, than the minimum average number of aggregate phase per imaginary line among the plurality of line groups.

* * * * *